United States Patent [19]

Fricano

[11] Patent Number: 4,927,063

[45] Date of Patent: May 22, 1990

[54] COMBINATION CAP HANGER AND VISOR PRESS

[76] Inventor: Gerald A. Fricano, 8 Watchet La., Fairport, N.Y. 14450

[21] Appl. No.: 343,895

[22] Filed: Apr. 26, 1989

[51] Int. Cl.[5] ..... A47G 25/10

[52] U.S. Cl. ..... 223/84; 223/14; 223/85

[58] Field of Search ..... 223/14, 24, 90, 91, 223/84, 85; 2/185–188, 199; 24/30.5, 508, 511

[56] References Cited

U.S. PATENT DOCUMENTS

| | | | |
|---|---|---|---|
| 1,840,665 | 1/1932 | Grauf | 223/91 |
| 4,394,791 | 7/1983 | Groth | 24/30.5 |
| 4,491,256 | 1/1985 | Payne et al. | 223/24 |
| 4,805,782 | 2/1989 | Hall et al. | 223/66 X |

FOREIGN PATENT DOCUMENTS

| | | | |
|---|---|---|---|
| 18769 | 6/1915 | Fed. Rep. of Germany | 24/508 |
| 506778 | 9/1930 | Fed. Rep. of Germany | 24/508 |

*Primary Examiner*—Werner H. Schroeder
*Assistant Examiner*—David K. Suto
*Attorney, Agent, or Firm*—Robert J. Bird

[57] ABSTRACT

A combination cap hanger and visor press includes pivotally connected spring loaded gripping members, adapted to receive a cap visor between them and curved in the direction appropriate to the cap visor. The curvature of the gripping members and the force of the spring combine to press the cap visor into a desired shape. Several alternatives for hanging the device and cap are disclosed.

5 Claims, 2 Drawing Sheets

COMBINATION CAP HANGER AND VISOR PRESS

BACKGROUND INFORMATION

This invention relates to a clip on device which is a combination visor press and hanger for a cap.

The cap to which this invention relates has a crown and an elongated front visor. Such caps are commonly known in this country as baseball caps, though they are widely used for all kinds of outdoor activity. The cap is made of cloth, but the visor usually includes a stiffener or body of some material such as cardboard sewn between outer cloth layers.

It is usually desired by the wearer, for reasons both aesthetic and practical, that the visor be shaped in a particular way, such as a downward concave curve, and that this shape be maintained. A common practice among younger wearers is to use rubber bands to hold the visor in a curved shape when the cap is not being worn. Older wearers often take no such pains, with the result that visors and caps become misshapen.

U.S. Pat. No. 4,491,256, issued Jan. 1, 1985 to Payne and McDonagh is the only relevant prior art that I know of. It discloses a cap insert, in the form of a cap, for placement within the cap especially after laundering. The insert helps to insure shape retention while the cap is drying.

SUMMARY OF THE INVENTION

In summary, the present invention is a combination cap hanger and visor press. It includes pivotally connected gripping members spring loaded toward their closed positon. The gripping members are adapted to receive a cap visor between them and are curved in the direction appropriate to the cap visor. The curvature of the gripping members and the force of the spring combine to press the cap visor into a desired shape. Several alternatives for hanging the device and cap are included.

DRAWING

DESCRIPTION

Figure 1:
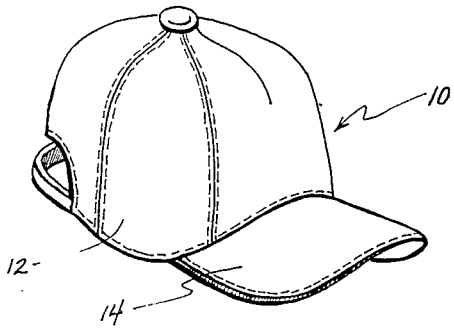
FIG. 1 is a perspective view of a cap with which this invention is used.

Referring now to the drawings, a cap 10 includes a crown section 12 and a visor 14. The visor is shown in its desired downward curved configuration, in which it is most effective to provide shade for the eyes.

Figure 2:
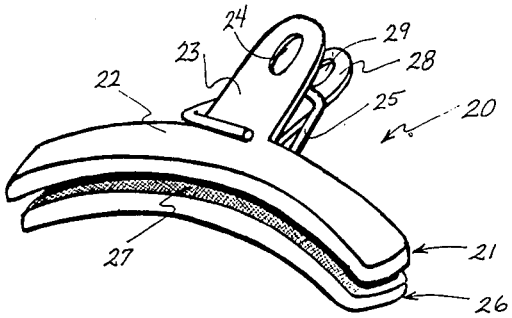
FIG. 2 is a perspective view of the cap hanger and visor press of this invention.

In FIG. 2, a combination cap hanger and visor press 20 (also referred to herein simply as a hanger press 20) includes a frist gripping member 21 and a cooperating second gripping member 26, both being generally T-shaped. The gripping member 21 includes a gripping crossbar 22 and a lever handle 23. The gripping crossbar 22 is curved in a plane generally perpendicular to the handle 23. The gripping member 26 includes a gripping crossbar 27 and a lever handle 28. The gripping crossbar 27 is curved in a plane generally perpendicular to the handle 28. Gripping members 21 and 26 are held together, and their crossbars 22 and 27 tightly pressed together, by a clip spring 25. The lever handles 23 and 28 include top apertures 24 and 29 respectively by which to hang the device on a hook or the like.

Figure 3:
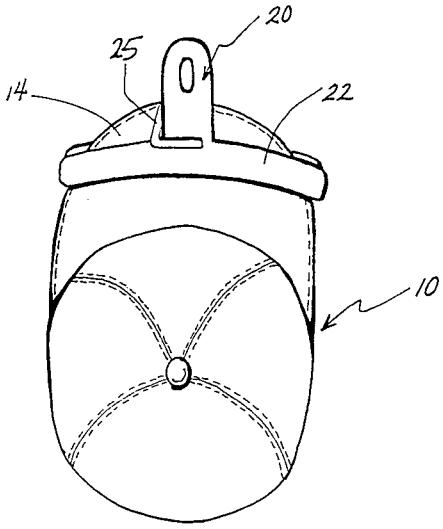
FIG. 3 shows the cap hanger and visor press in engagement with a cap.

In FIG. 3, the cap hanger and visor press 20 engages the visor 14 of the cap 10. The curvature of the gripping crossbars 22, 27 and the action of spring 25 effectively press the cap visor into its desired shape and keep it in this shape when the cap is not worn. The cap 10 and hanger press 20 are hung on a hook by one of the handle apertures 24 or 29.

Figure 4:
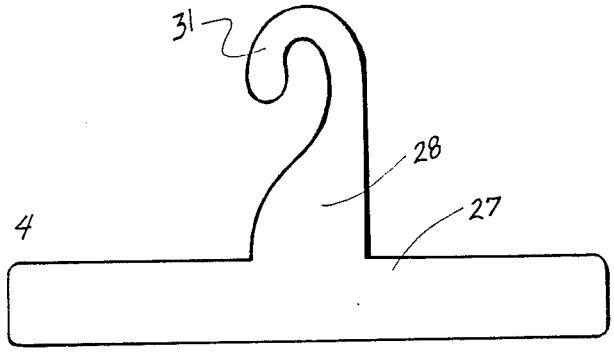
FIGS. 4–6 show other forms of the cap hanger and visor press.
Figure 5:
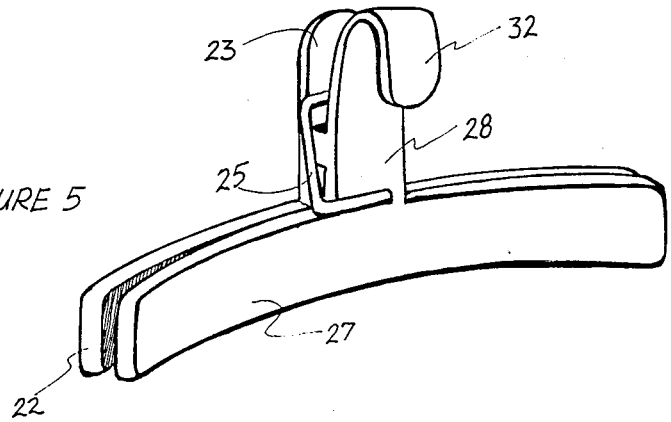
Figure 6:
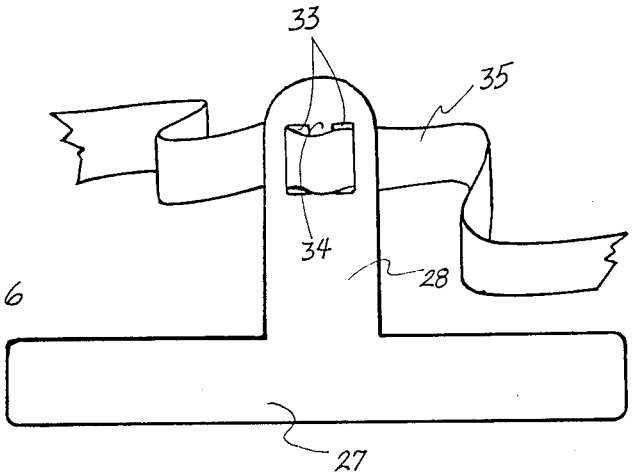

FIGS. 4–6 show alternative arrangements for hanging the device. In FIG. 4, the lever handle 28 includes a hook portion 31 extending in the direction of the gripping crossbar 27, suitable for hanging the hanger press 20 on an ordinary closet rod. In FIG. 5, the lever handle 28 includes a hook portion 32 extending in a direction normal to the gripping crossbar 27, suitable for hanging the hanger press 20 on any available protruding edge, such as the edge of a shelf or the upper periphery of an equipment bag or the like. In FIG. 6, the lever handle 28 includes a pair of apertures 33 separated by a center strip 34 to form a belt loop or buckle by which the hanger press 20 can be mounted by a strap or belt 35, for example to a golf bag.

Spring loaded clips, such as are used for clipping papers together, are well known. They are available in various forms, and include various forms of springs. All such known spring configurations as would be appropriate for use in the hanger press of this invention are within the intended scope of this invention.

The foregoing description of preferred embodiments of this invention is intended as illustrative. The concept and scope of the invention are limited only by the following claims and equivalents thereof.

What is claimed is:

1. A combination cap hanger and visor press, including:

first and second T-shaped gripping members each including a lever handle and a gripping crossbar, said gripping members pivotally connected for movement between open and closed positions and spring loaded toward said closed position;

said gripping crossbars mating with each other and defining therebetween a concave cavity curved in a plane substantially perpendicular to said lever handles, said gripping crossbars adapted to receive a cap visor between them, the curvature of said gripping crossbars and the force of said spring load combining to retain said cap visor in a desired shape; and hanging means to hang said cap hanger and visor press.

2. A combination cap hanger and visor press as defined in claim 1;

said hanging means including an aperture in one of said handles.

3. A combination cap hanger and visor press as defined in claim 1;

said hanging means including a hook on one of said handles extending substantially in the direction of the gripping crossbar thereof.

4. A combination cap hanger and visor press as defined in claim 1;

said hanging means including a hook on one of said handles extending in a direction substantially normal to the gripping crossbar thereof.

5. A combination cap hanger and visor press as defined in claim 1;

said hanging means including a pair of apertures in one of said handles forming a belt loop.

* * * * *